United States Patent [19]

Suzuki

[11] Patent Number: 4,620,606

[45] Date of Patent: Nov. 4, 1986

[54] LOUDSPEAKER OF PLANE DIAPHRAGM TYPE

[75] Inventor: Akihisa Suzuki, Higashihiroshima, Japan

[73] Assignee: Sharp Kabushiki Kaisha, Osaka, Japan

[21] Appl. No.: 740,211

[22] Filed: Jun. 3, 1985

[51] Int. Cl.[4] ..... H04R 7/12

[52] U.S. Cl. ..... 181/170

[58] Field of Search ..... 181/157, 164, 167–170, 181/DIG. 1

[56] References Cited

U.S. PATENT DOCUMENTS 1,480,785 1/1924 Semple, Jr. ..... 181/170 X 3,285,364 11/1966 Cohen ..... 181/167 X 4,100,992 7/1978 Rehde et al. ..... 181/167 X 4,275,278 6/1981 Sakurai et al. ..... 181/170 X 4,478,309 10/1984 Kawamura et al. ..... 181/169 X

*Primary Examiner*—Benjamin R. Fuller

*Attorney, Agent, or Firm*—Flehr, Hohbach, Test, Albritton & Herbert

[57] ABSTRACT

A loudspeaker of plane diaphragm type has a skin-like material with smaller diameter than that of the plane diaphragm pasted thereon so that the skin-like material will not stick out of the diaphragm surface and the edge piece surrounding it can securely support the plane diaphragm, preventing unpleasant noises and split vibrations.

7 Claims, 4 Drawing Figures

LOUDSPEAKER OF PLANE DIAPHRAGM TYPE

This invention relates to an improved loudspeaker of plane diaphragm type having a skin-like material pasted on the front surface of a plane diaphragm and an edge piece around it.

Plane diaphragms with superior directivity have been developed and they are currently taking the place of cone-type diaphragms in speaker units. As shown in FIG. 1, a loudspeaker of plane diaphragm type comprises a frame 1 and a magnetic circuit 2 of a conventional type of loudspeaker and a plane diaphragm 3 filled with a foam material instead of cone-type paper. A skin-like material 4 such as a metal, resin and paper is pasted to cover the surface roughness and also to improve the radiation efficiency and external appearance. An edge piece 5 is further pasted around the skin-like material 4 to support the plane diaphragm 3.

Since the diameter of the plane diaphragm 3 and that of the skin-like material 4 are nearly the same, a small error in positioning the skin-like material 4 with respect to the plane diaphragm 3 causes a portion of the skin-like material 4 to stick out from the edge of the diaphragm as shown in FIG. 2. As a result, the edge piece 5 pasted onto the skin-like material 4 floats in air and this tends to cause unpleasant noises and split vibrations. In order to paste the skin-like material correctly on the diaphragm, a device 6 shown in FIG. 3 is sometimes used, but this causes an increase in the cost of production.

It is therefore an object of this invention in view of the above to provide a loudspeaker of a plane diaphragm type which is so designed that the skin-like material will not stick out from the plane diaphragm. This and other objects of the present invention are attained by making the diameter of the skin-like material smaller than that of the plane diaphragm.

Figure 1:
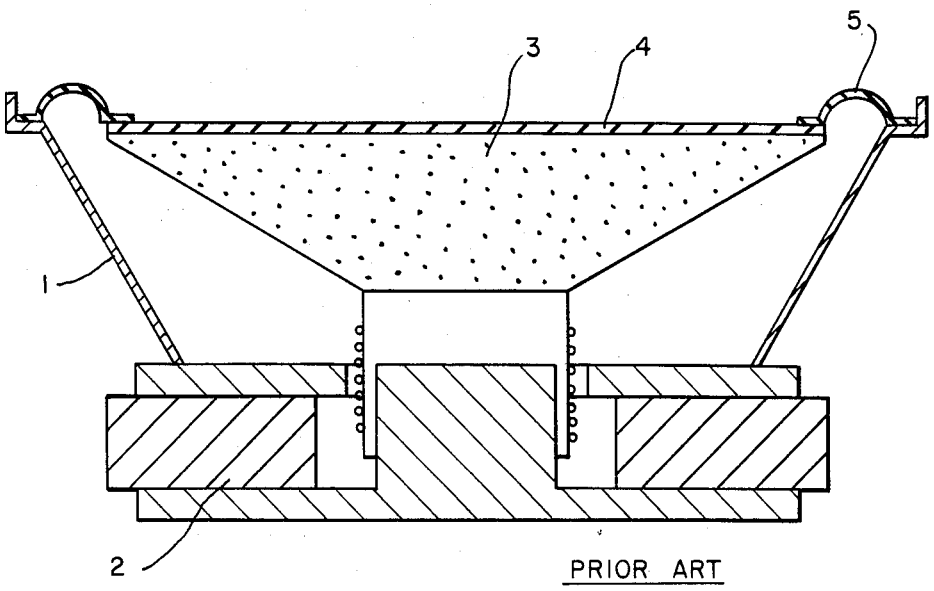
FIG. 1 is a cross-sectional view of a conventional loudspeaker of plane diaphragm type.
Figure 2:
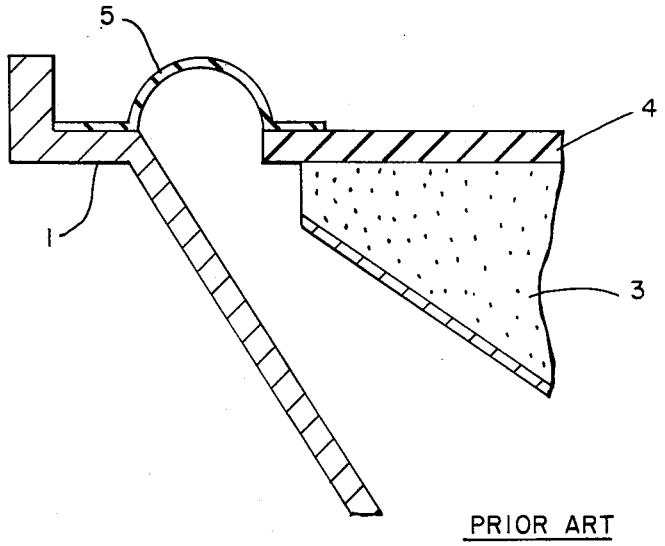
FIG. 2 is an enlarged cross-sectional view of a portion of the loudspeaker of FIG. 1.
Figure 3:
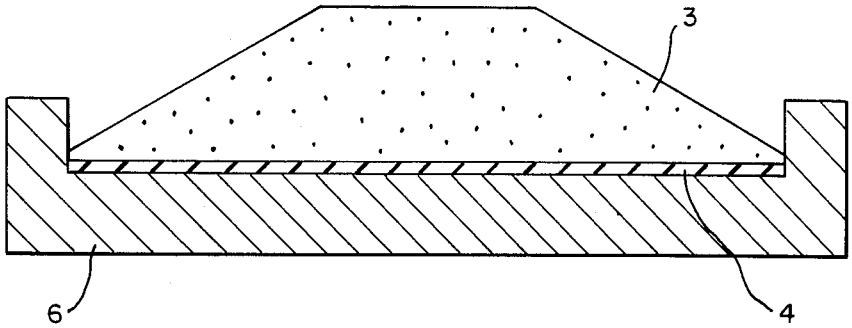
PRIOR ART FIG.—3
FIG. 3 is a cross-sectional view showing a method of manufacturing the loudspeaker of FIG. 1.
Figure 4:
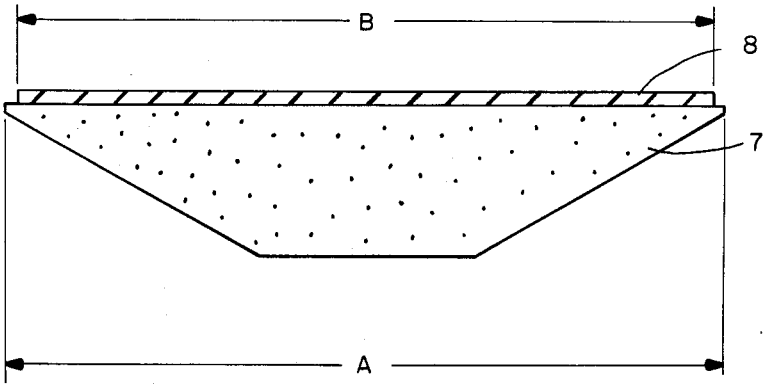
FIG. 4 is a cross-sectional view of a loudspeaker embodying the present invention.

In FIG. 4 which illustrates the present invention, numeral 7 is a plane diaphragm of diameter A filled with a foam material. A skin-like material 8 of metal, resin or paper with diameter B is pasted on the surface of the plane diaphragm 7, but B is smaller than A so that the skin-like material will not stick out from the edge of the diaphragm even if there is a small error in the positioning of the skin-like material. The edge piece which is pasted around the skin material is always supported by the plane diaphragm and will not float. Unpleasant noises and split vibrations mentioned above can thus be prevented.

In summary, the loudspeaker of plane diaphragm type according to the present invention has a skin-like material with surface area smaller than that of the plane diaphragm. Thus, the requirement of precision in the production process is less stringent and hence the loudspeaker can be manufactured at a lower cost.

The present invention has been described above in terms of only one embodiment, but the description given above is intended to be interpreted as illustrative rather than as limiting. The scope of this invention is limited only by the following claims.

What is claimed is:

1. A loudspeaker of plane diaphragm type comprising a plane diaphragm with a surface and a single-piece skin-like material which is smaller than said plane diaphragm and is pasted on said surface, the peripheral areas of said surface being substantially entirely exposed.

2. The loudspeaker of claim 1 wherein said skin-like material is metallic.

3. The loudspeaker of claim 1 wherein said skin-like material is made of resin.

4. The loudspeaker of claim 1 wherein said skin-like material is made of paper.

5. The loudspeaker of claim 1 further comprising an edge piece pasted around said skin-like material.

6. The loudspeaker of claim 1 wherein said surface is circular.

7. The loudspeaker of claim 1 wherein said plane diaphragm is filled with a foam material.

* * * * *